US005221241A

United States Patent [19]

Bare, II

[11] Patent Number: 5,221,241

[45] Date of Patent: Jun. 22, 1993

[54] GYMNASTIC TRAINING DEVICE

[76] Inventor: Frank L. Bare, II, 6320 S. 2141 East, Salt Lake City, Utah 84121

[21] Appl. No.: 820,201

[22] Filed: Jan. 13, 1992

[51] Int. Cl.[5] ..... A63B 1/00

[52] U.S. Cl. ..... 482/43; 482/23; 482/27; 482/38; 482/124

[58] Field of Search ..... 482/69, 23, 27, 29, 482/38, 41, 43, 121, 124, 126; 5/83.1, 88.1

[56] References Cited

U.S. PATENT DOCUMENTS 3,006,645 10/1961 Frazier ..... 482/43
4,410,175 10/1983 Shamp ..... 482/69

FOREIGN PATENT DOCUMENTS 1416140 8/1988 U.S.S.R. ..... 482/43
1556691 4/1990 U.S.S.R. ..... 482/24

*Primary Examiner*—Richard J. Apley
*Assistant Examiner*—Jeanne M. Mollo
*Attorney, Agent, or Firm*—Zarley, McKee, Thomte, Voorhees & Sease

[57] ABSTRACT

A gymnastic training device has a conventional training belt adapted to support a gymnast at the waist. A pair of elongated resilient supporting assemblies are attached to opposite sides of the training belt and are comprised of bungy cords which can be selectively added or removed with respect to the assemblies to adjust the resilient capabilities thereof. A pulley support means including a pair of laterally positioned pulleys and at least one elevated pulley are supported over the normal position of the training belt by either a self-standing frame or by a frame assembly attached to the ceiling of a building. A first cable has a center portion and opposite ends with the opposite ends being secured to each of the free ends of the elongated resilient supporting assemblies. The first cable has its center portion threaded over the laterally positioned pulleys and the elevated pulley whereby the training belt is centrally supported between and below the laterally positioned pulleys and above a generally horizontal gymnastic surface. A loop is formed in the first cable and extends downwardly below one of the laterally positioned cables. The loop has a pulley thereon which is secured to the upper end of a second cable which has its lower end secured to an anchored crank mechanism whereby the operation of the crank mechanism can adjust the length of the first cable and thereby adjust the effective height of the training belt.

16 Claims, 3 Drawing Sheets

GYMNASTIC TRAINING DEVICE

BACKGROUND OF THE INVENTION

The Pond training belt has long been used by gymnasts for training purposes. That belt fits around the waist of the gymnast and permits the gymnast to rotate with respect to the belt about a vertical axis, and also permits the gymnast to rotate about a horizontal axis defined by supporting swivels on opposite sides of the belt. The swivels are normally supported by cables which are either mechanically or manually anchored. Gymnasts using the Pond belt often use a trampoline in conjunction with the training exercise.

Among the shortcomings of existing gymnastic training devices is the inability of these devices to easily accommodate persons of different weight. In addition, they either cannot be adjusted to prevent full or substantial impact of the gymnast on a gymnastic surface, or can be adjusted only with considerable difficulty. In addition, existing devices invite the likelihood that the gymnasts can be injured at the apex of a routine by striking an overhead structure.

SUMMARY OF THE INVENTION

It is therefore a principal object of this invention to provide a gymnastic training device which can be easily adapted to persons of different weight.

A further object of this invention is to provide a gymnastic training device which uses resilient supporting means for the gymnast which can be easily adjusted to accommodate the specific weight of the gymnast, and to regulate the degree of impact that the gymnast has with a supporting gymnastic surface.

A still further object of this invention is to provide a gymnastic training device which can be adjusted to prevent the gymnast from engaging the gymnastic surface while in a substantially horizontal position.

A still further object of this invention is to provide a gymnastic training device which will automatically negate the propelling power of the resilient gymnast supporting means during the apex of a routine to prevent the gymnast from striking any overhead structure.

A still further object of this invention is to provide a gymnastic training device which can be utilized in either a self-standing format, or adapted to the ceiling structure of a building.

These and other objects will be apparent to those skilled in the art.

The gymnastic training device of this invention utilizes a conventional training belt adapted to support a gymnast at the waist. A pair of elongated resilient supporting assemblies are attached to opposite sides of the training belt. A pulley support means including a pair of laterally positioned pulleys and at least one elevated pulley are supported over the normal position of the training belt by either a self-standing frame or by a frame assembly attached to the ceiling of a building.

A first cable has a center portion and opposite ends with the opposite ends being secured to each of the free ends of the elongated resilient supporting assemblies. The first cable has its center portion threaded over the laterally positioned pulleys and the elevated pulley whereby the training belt is centrally supported between and below the laterally positioned pulleys and above a generally horizontal gymnastic surface.

A loop is formed in the first cable and extends downwardly below one of the laterally positioned cables. The loop has a pulley thereon which is secured to the upper end of a second cable which has its lower end secured to an anchored crank mechanism whereby the operation of the crank mechanism can adjust the length of the first cable and thereby adjust the effective height of the training belt. Individual bungy cords comprise the elongated resilient supporting assembly, and these cords can be selectively added or removed with respect to the assemblies to adjust the resilient capabilities thereof.

DESCRIPTION OF THE PREFERRED EMBODIMENT

The gymnastic training device 10 of this invention is adapted for use by athletics who may be training for a plurality of different gymnastic events. It is adapted for use by gymnasts who, for example, may be practicing for floor exercise or balance beam routines; by divers; free style skiers, cheerleaders, or trampolinists or the like. The device 10 is normally used on or over a gymnastic surface 11, but is also commonly used in conjunction with a gymnastic surface which is the resilient bed of a trampoline.

Figure 1:
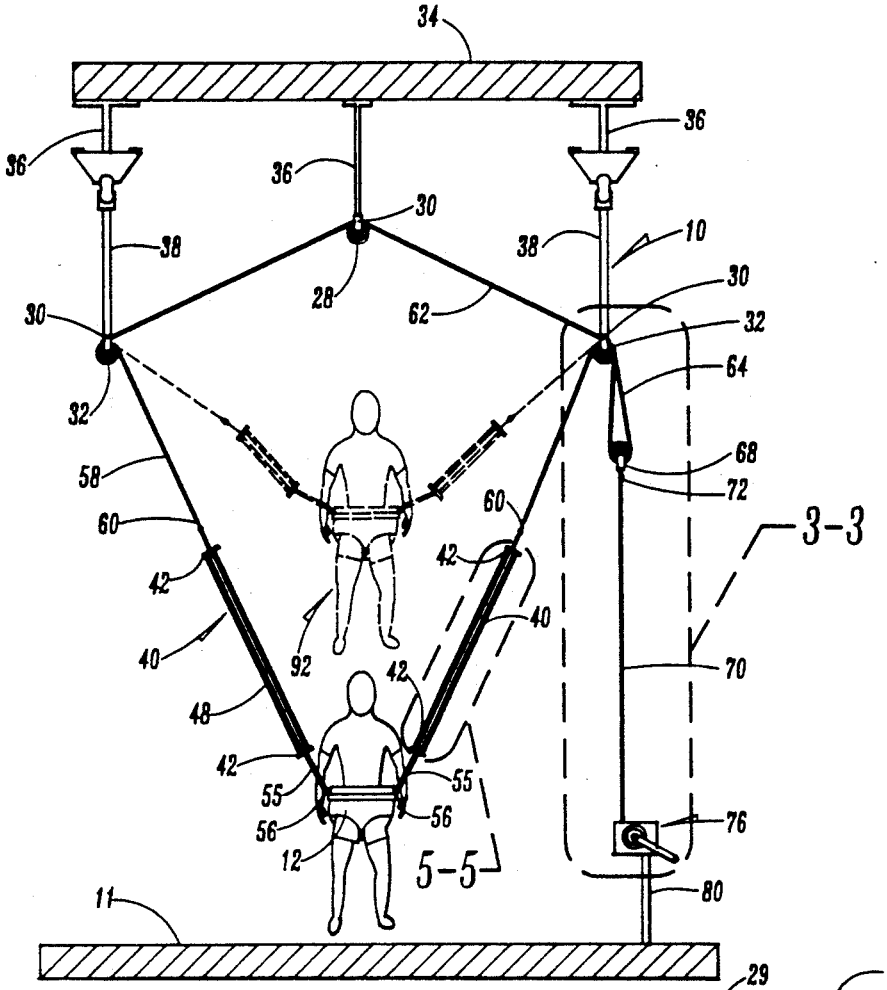
FIG. 1 is a front elevational view of the gymnastic training device of this invention mounted from the ceiling of a building.
Figure 2:
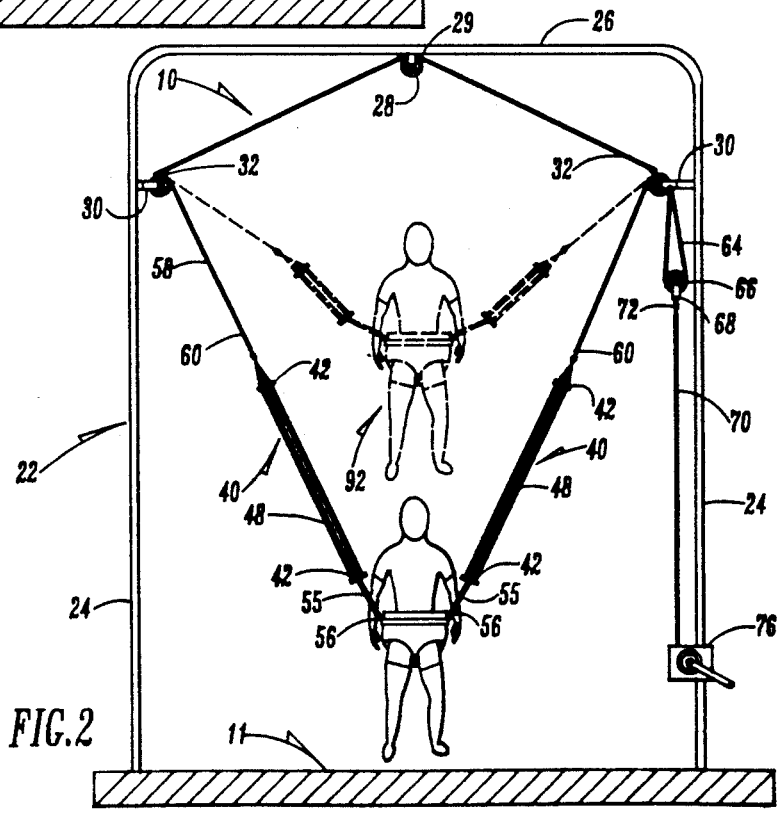
FIG. 2 is a front elevational view of the gymnastic training device of this invention mounted on a self-standing supporting frame.
Figure 6:
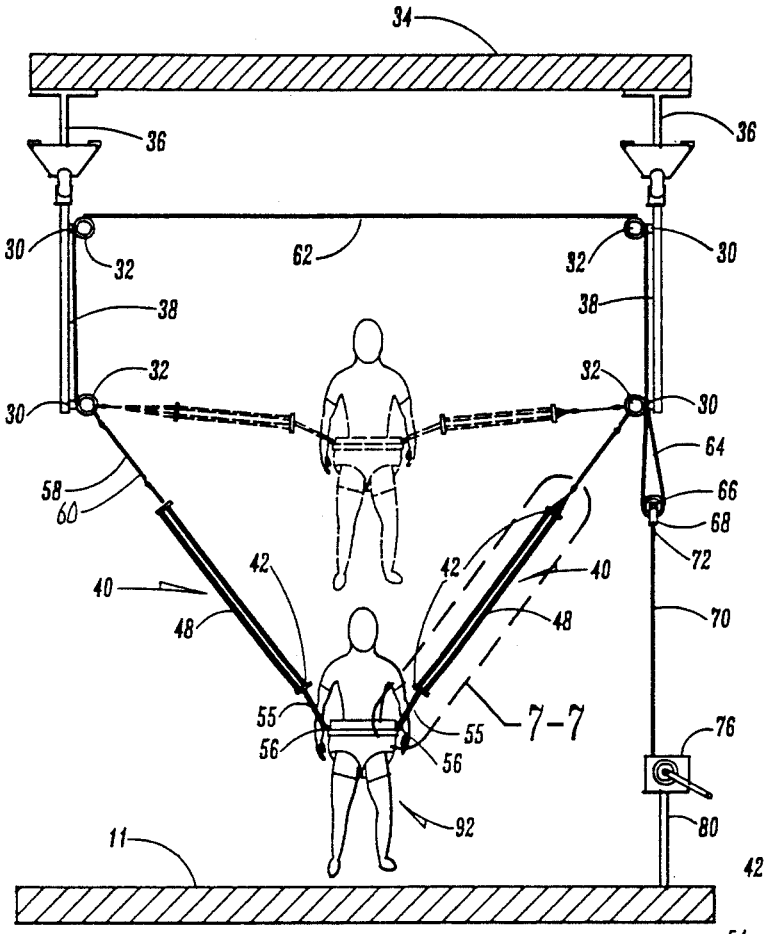
FIG. 6 is a view similar to that of FIG. 1 but shows a modified form of the invention utilizing four pulleys instead of three.
Figure 7:
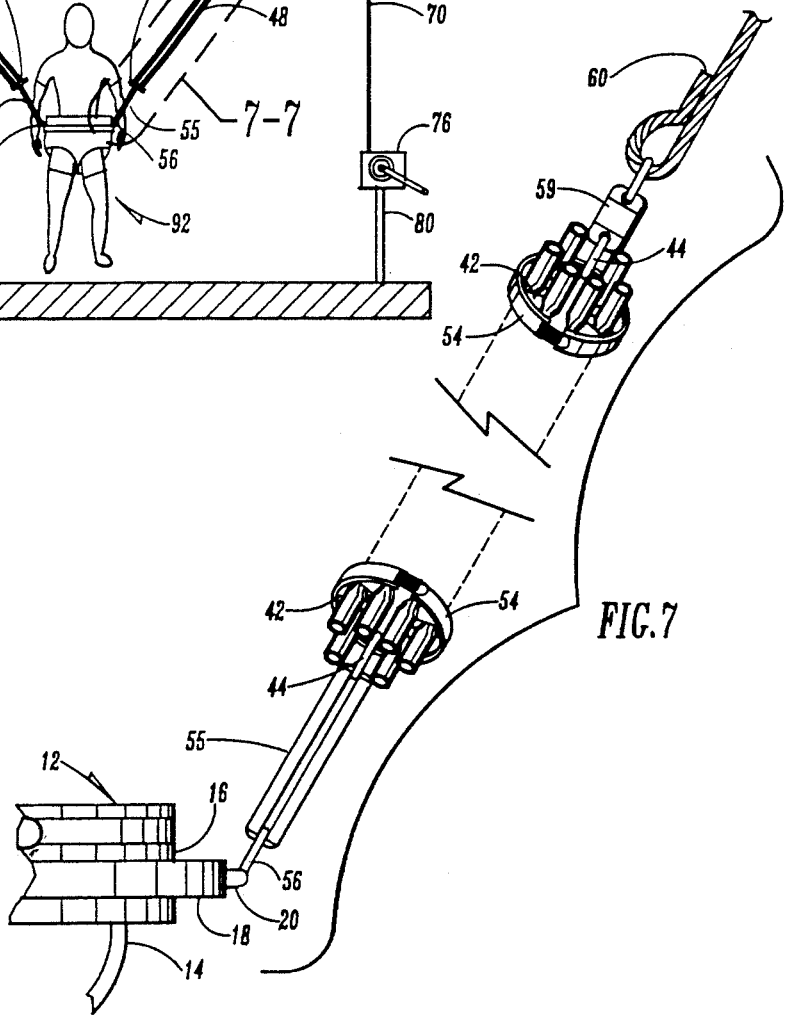
FIG. 7 is an exploded view at an enlarged scale of the structure shown by the line 7-7 of FIG. 6.

The numeral 12 designates the conventional Pond training belt which is shown in FIGS. 1, 2 and 6, and which has some of its detailed structure shown in FIG. 7. The Pond belt 12 is normally worn around the waist of the gymnast. It includes a gymnast support means 14, a belt structure 16 which is rotatably mounted within a rotational bracket 18, with swivels 20 secured on opposite sides thereof which are adapted to rotate about a horizontal axis.

Figure 3:
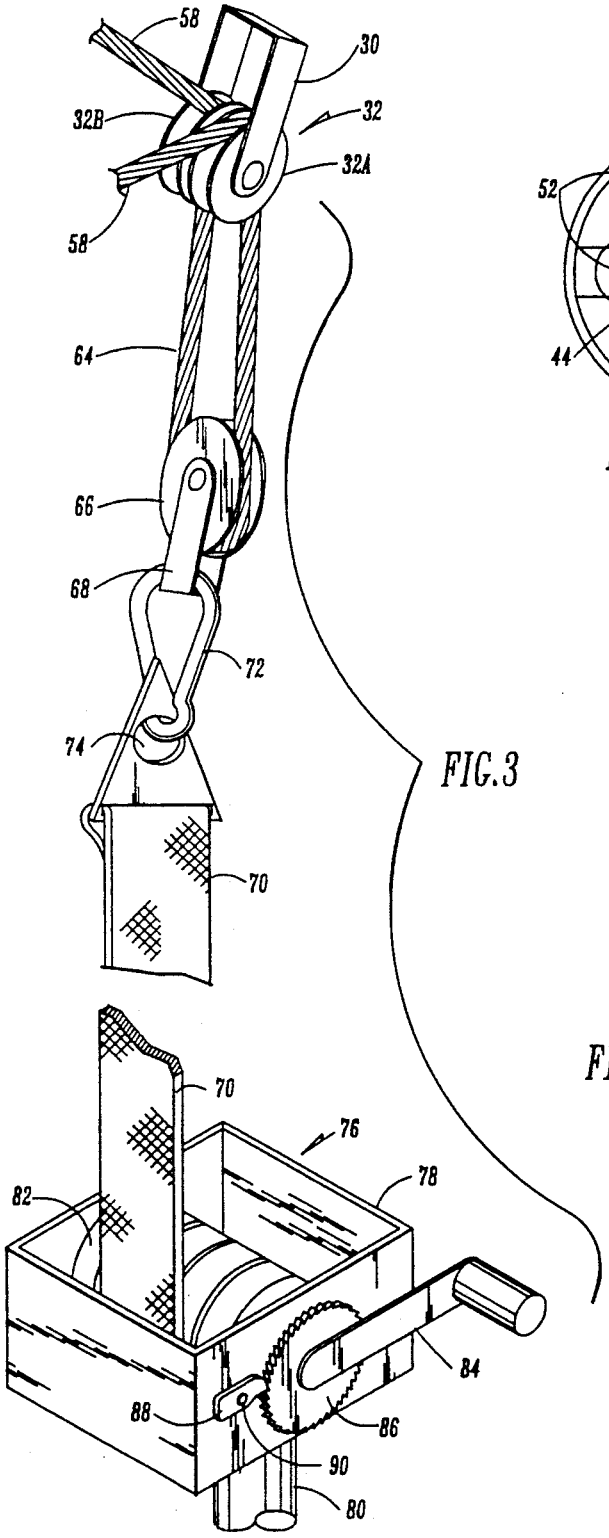
FIG. 3 is an exploded view of the structure encompassed by the line 3—3 of FIG. 1.
Figure 4:
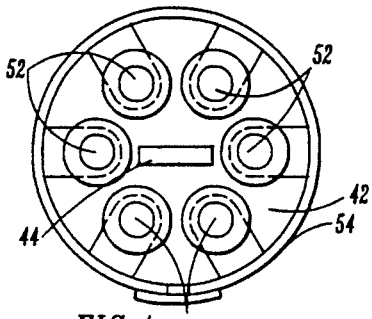
FIG. 4 is a top plan view shown at an enlarged scale taken on line 4—4 of FIG. 5.

A pulley support frame 22 is shown in FIG. 2 and is comprised of vertical legs 24 which are interconnected by horizontal top portion 26. An elevated top pulley 28 is secured to the mid point of portion 26 by a bracket 29. Similarly, brackets 30 are secured to the upper portions of legs 24 to support laterally positioned pulleys 32 at a level below that of top pulley 28. As shown in FIG. 3, the lateral pulleys are comprised of two pulley elements 32A and 32B.

A modification of the supporting structure of the device of this invention is shown in both FIGS. 1 and 6. In those Figures, the device 10 is supported from a ceiling or roof structure 34 by means of support bracket 36 (FIG. 1) which supports top pulley 28, and vertical support brackets 38 which support the laterally positioned pulleys 32. In FIG. 6, vertical support brackets 36 extend downwardly from the ceiling 34 with an elevated top pulley 28 being secured adjacent the upper portion of the brackets 36, and with the laterally positioned pulleys 32 being secured adjacent the lower ends of the brackets 36.

A shock absorber element 40 is secured by one of its ends to each of the swivels 20 on training belt 12 as best shown in FIG. 7. The shock absorber elements are comprised of upper and lower discs 42 which each have a centrally protruding eyelet 44. Each disc has a plurality of radial slits 46 which are adapted to receive compressively the end portions of hollow resilient bungy cords 48. The bungy cords 48 each have enlarged diameter upper and lower ends 50 which are created by forcibly inserting short lengths of dowels 52 into the ends of the hollow bungy cords. The enlarged diameter upper and lower ends 50 of the bungy cords are sufficiently great to prevent them from longitudinally slipping through the radial slits 46. A conventional band clamp 54 encircles the perimeter of each of the discs 42, (FIG. 7) and is tightened on the periphery thereof. Band clamps 56 prevent the bungy cords from moving laterally out of the radial slits 46.

The resiliency of shock absorber elements 40 can be selectively adjusted by removing band clamps 54 from the disc, and adding or removing bungy cords as the situation may require.

The eyelet 44 on the lower end of shock absorber element 40 is connected to swivel 20 of training belt 12 by links 55 and 56 (FIG. 7).

A first cable 58 has lower ends 60 which are secured by the link assembly 59 (FIG. 7) to the eyelets 44 on the upper ends of shock absorber elements 40. Cable 58 has a center portion 62 which defines its length in between ends 60. The cable 58 also has a loop portion 64, best shown in FIG. 3, which is located below one of the laterally positioned pulleys 32. Loop portion 64 is created as the cable 58 is threaded over pulley element 32A, thence downwardly, and thence upwardly over pulley element 32B. A pulley 66 is mounted on the loop portion 64 of cable 58. A conventional bracket 68 is secured to pulley 66 and is secured to a downwardly extending belt 70 by swivel connector 72 which engages an eyelet 74 in the upper end of belt 70.

A ratchet crank 76 has a frame 78 which is secured to leg 24 of frame 22 as seen in FIG. 1, or which is secured to upwardly extending post 80 in the structures of FIGS. 1 and 6. With reference to FIG. 3, ratchet crank 76 also includes a drum 82 rotatably mounted within frame 78. A crank arm 84 is secured to ratchet wheel 86 which in turn is connected to drum 82 so that the drum can be rotated with respect to the frame 78. A conventional pawl 88 is pivotally secured to frame 78 by pin 90, and is adapted, when engaging ratchet wheel 86, to prevent drum 82 from rotating. When the pawl is rotated from out of engagement with ratchet wheel 86, by pivoting the pawl 88 on pin 90, the drum 82 can be rotated with respect to the frame by crank arm 84.

The athlete or gymnast is designated by the numeral 92 in FIGS. 1, 2 and 6. The device can be mounted over a gymnastic surface 11 which can be a gymnasium floor (preferably padded), or an outdoor grass surface. Similarly, it can be mounted over the horizontal resiliently mounted trampoline mat.

Figure 5:
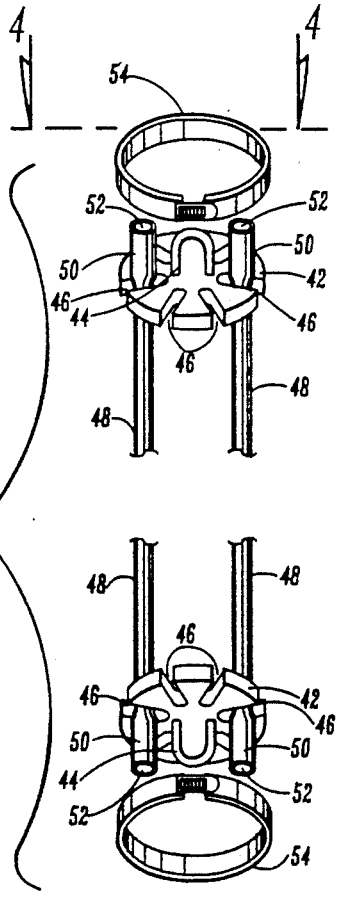
FIG. 5 is an exploded schematic view of the resilient supporting assembly or shock absorber element which interconnect the training belt and the supporting cable as shown by the line 5—5 in FIG. 1.

The athlete 92 has the conventional training belt 12 secured around the waist portion. If the athlete is a heavy adult, all of the bungy cords 48 may be used as shown in FIG. 7. If the athlete is a lighter weight child, for example, some of the bungy cords can be removed as described above and as typically shown in FIG. 5.

The weight of the athlete should expand the shock absorber elements 40 so that the feet of the athlete can at least touch the surface 11. However, it is important that the training belt 12 be maintained at a sufficient height so that the athlete cannot engage the surface 11 if in a substantial horizontal position. It is also important that even upon dynamic expansion of the shock absorber elements 40, the system be adjusted so that the athlete experiences no more than 15 to 20 pounds of impact on the supporting surface 11. This fine tuning of the training device 10 can take place by use of the crank 76 which can be operated to either lengthen or shorten the center portion 62 of cable 58 to raise or lower the position of the athlete 92 as suspended in the training belt 12.

As reflected in FIGS. 1, 2 and 6, as the athlete moves upwardly to the positions shown by the dotted lines in these figures, the shock absorber elements 40 contract by reason of both the position of the lateral pulleys 32, and the lack of tension in the cable 58. As a result, the shock absorber elements 40 will not continue to propel the athlete upwardly so as to possibly engage the overhead structure including either the top portion 26 of frame 22, the elevated pulleys 28, or the ceiling structure 34.

The routines of the athlete are initiated by the athlete springing upward from a standing position on surface 11. The upward movement is accentuated by the contraction of the shock absorbers 40. While in the upward position, the athlete can swivel within training belt 12, or can extend the body to perform twists or flips while in the upward position. Gravity will obviously cause the athlete to then move downwardly to a lower position, but the configuration of the device as described above will prevent any substantial impact as the athlete reengages the surface 11, whereupon the routine can be continued as the athletic springs to the upward position again.

It it therefore seen that this device will achieve at least its stated objectives.

I claim:

1. A gymnastic training device, comprising, a training belt means to support a gymnast at the waist and having opposite sides, a pair of elongated resilient means attached to said opposite sides of said training belt means, a pulley support means including a pair of laterally positioned pulleys and at least one elevated pulley above said laterally positioned pulleys, a first cable having a center portion and opposite ends secured respectively to one each of said resilient means, said first cable having its center portion threaded over said lateral positioned pulleys and said elevated pulley whereby said training belt means is centrally supported between and below said laterally positioned pulley and above a generally horizontal gymnastic surface, and adjusting means to selectively change the length of said center portion of said cable extending among said laterally spaced pulleys and said elevated pulley.

2. The device of claim 1 wherein said resilient means is comprised of a plurality of bungy cords.

3. The device of claim 1 wherein said adjusting means is a crank means operatively secured to said first cable.

4. The device of claim 1 wherein said pulley support means is a self-standing frame mounted on a supporting surface located below said training belt means and extending upwardly and over said training belt means.

5. The device of claim 1 wherein said pulley support means is suspended downwardly from an overhead ceiling means of a building housing said device.

6. A gymnastic training device, comprising, a training belt means to support a gymnast at the waist and having opposite sides, a pair of elongated resilient means attached to said opposite sides of said training belt means, said resilient means being comprised of a plurality of bungy cords, said resilient means further including a pair of spaced disc members, with said bungy cords having opposite ends detachably secured to said disc members whereby the number of bungy cords on each resilient means can be selectively varied, a pulley support means including a pair of laterally positioned pulleys and at least one elevated pulley above said laterally positioned pulleys, a first cable having a center portion and opposite ends secured respectively to one each of said resilient means, said first cable having its center portion threaded over said lateral positioned pulleys and said elevated pulley whereby said training being means is centrally supported between and below said laterally positioned pulley and above a generally horizontal gymnastic surface, and adjusting means to selectively change the length of said center portion of said cable extending among said laterally spaced pulleys and said elevated pulley.

7. The device of claim 6 wherein said disc members have a plurality of slots, with the opposite ends of said bungy cords being detachably secured within said slots.

8. The device of claim 7 wherein said bungy cords are hollow, dowel elements being forcibly positioned within the opposite ends of said bungy cords to effectively increase the normal cross sectional areas thereof to prevent the longitudinal removal of said bungy cords from said slots.

9. The device of claim 8 wherein said slots are radially formed in said disc members and have open outer ends to permit the removal of said bungy cords from said slots through said open outer ends.

10. The device of claim 9 wherein an elongated clamping strap is removably mounted around said disc members to prevent the lateral removal of said bungy cords from said slots while said clamping strap is in place.

11. A gymnastic training device, comprising, a training belt means to support a gymnast at the waist and having opposite sides, a pair of elongated resilient means attached to said opposite sides of said training belt means, a pulley support means including a pair of laterally positioned pulleys and at least one elevated pulley above said laterally positioned pulleys, a first cable having a center portion and opposite ends secured respectively to one each of said resilient means, said first cable having its center portion threaded over said lateral positioned pulleys and said elevated pulley whereby said training belt means is centrally supported between and below said laterally positioned pulley and above a generally horizontal gymnastic surface, and a crank means operatively secured to a loop in said first cable to selectively change the length of said center portion of said cable extending among said laterally spaced pulleys and said elevated pulley.

12. The device of claim 11 wherein said crank means is a crank element connected to a supporting surface underneath said training belt means, a loop being formed in said cable means adjacent one of said laterally positioned pulleys, an adjusting pulley engaging said loop, and a second cable connecting said adjusting pulley and said crank element.

13. The device of claim 12 wherein said loop is comprised of a length of said first cable which is threaded over and thence downwardly over one of said laterally positioned pulleys, and thence upwardly and over said one of said laterally positioned pulleys.

14. The device of claim 11 wherein said loop is comprised of a length of said first cable which is threaded over and thence downwardly over one of said laterally positioned pulleys, and thence upwardly and over said one of said laterally positioned pulleys.

15. A gymnastic training device, comprising, a training belt means to support a gymnast at the waist and having opposite sides, a pair of elongated resilient means attached to said opposite sides of said training belt means, a pulley support means including a pair of laterally positioned pulleys and an elevated pulley above and centered between said laterally positioned pulleys, a first cable having a center portion and opposite ends secured respectively to one each of said resilient means, said first cable having its center portion threaded over said lateral positioned pulleys and said elevated pulley whereby said training belt means is centrally supported between and below said laterally positioned pulley and above a generally horizontal gymnastic surface, and adjusting means to selectively change the length of said center portion of said cable extending among said laterally spaced pulleys and said elevated pulley.

16. A gymnastic training device, comprising, a training belt means to support a gymnast at the waist and having opposite sides, a pair of elongated resilient means attached to said opposite sides of said training belt means, a pulley support means including a pair of laterally positioned pulleys and a pair of elevated pulleys positioned substantially directly above said laterally positioned pulleys, a first cable having a center portion and opposite ends secured respectively to one each of said resilient means, said first cable having its center portion threaded over said lateral positioned pulleys and said elevated pulley whereby said training belt means is centrally supported between and below said laterally positioned pulley and above a generally horizontal gymnastic surface, and adjusting means to selectively change the length of said center portion of said cable extending among said laterally spaced pulleys and said elevated pulley.

* * * * *